US008781357B2

(12) United States Patent
Miwa et al.

(10) Patent No.: US 8,781,357 B2
(45) Date of Patent: Jul. 15, 2014

(54) IMAGE FORMING APPARATUS

(71) Applicant: Canon Kabushiki Kaisha, Tokyo (JP)

(72) Inventors: Koji Miwa, Susono (JP); Yuji Mitsui, Susono (JP); Keita Nakajima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/692,896

(22) Filed: Dec. 3, 2012

(65) Prior Publication Data

US 2013/0142538 A1 Jun. 6, 2013

(30) Foreign Application Priority Data

Dec. 6, 2011 (JP) ..... 2011-267152

(51) Int. Cl.
*G03G 21/20* (2006.01)
*G03G 21/18* (2006.01)

(52) U.S. Cl.
CPC ..... *G03G 21/20* (2013.01); *G03G 21/1853* (2013.01)
USPC ..... 399/92; 399/111

(58) Field of Classification Search
CPC . G03G 21/20; G03G 15/751; G03G 21/1853; G03G 2221/1645
USPC ..... 399/92, 94, 96, 111
See application file for complete search history.

(56) References Cited

U.S. PATENT DOCUMENTS

| | | | | |
|---|---|---|---|---|
| 7,593,663 | B2 * | 9/2009 | Nogami | 399/92 |
| 8,000,629 | B2 * | 8/2011 | Tamura | 399/111 |

FOREIGN PATENT DOCUMENTS

| | | | |
|---|---|---|---|
| JP | 4-168067 | A | 6/1992 |
| JP | 5-035003 | A | 2/1993 |
| JP | 2001-175046 | A | 6/2001 |
| JP | 2002-072597 | A | 3/2002 |
| JP | 2007-226148 | A | 9/2007 |
| JP | 2008-268528 | A | 11/2008 |
| JP | 2009-288583 | A | 12/2009 |
| JP | 2010-244010 | A | 10/2010 |

* cited by examiner

*Primary Examiner* — Hoang Ngo
(74) *Attorney, Agent, or Firm* — Canon USA, Inc., IP Division

(57) ABSTRACT

An image forming apparatus for forming an image on a recording material by exposing a photosensitive member with a light emitting member in a state where a cartridge including the photosensitive member is mounted in an apparatus main body includes a light emitting member, a support member, and a duct formed in the support member. The light emitting member includes a plurality of light emitting portions arranged in an array. The support member supports the light emitting member. The duct forms an air supply path extending in a longitudinal direction of the cartridge to cool the cartridge mounted in the apparatus main body.

7 Claims, 9 Drawing Sheets

IMAGE FORMING APPARATUS

BACKGROUND OF THE INVENTION

1. Field of the Invention

The present invention relates to an electrophotographic image forming apparatus for forming an image on a recording material.

2. Description of the Related Art

Recently, a further speedup has been required of the electrophotographic image forming apparatus such as a printer, a facsimile, or a copying machine. Generally, as the speed up progresses, along with increase of a temperature of a fixing device, a rotational speed of a driving unit or an increase of used current due to increase of a size of a substrate of power source, temperature in the image forming apparatus tends to increase. When the temperature in the interior of the image forming apparatus increases, in turn, a temperature around a cartridge that includes a photosensitive drum (image bearing member), a development unit, and a cleaning unit increases. Temperature of members themselves in the cartridge tends to perform self temperature rise by the speed up.

Japanese Patent Application Laid-Open No. 2008-268528 discusses a technique for cooling the cartridge in order to prevent problems such as an image forming failure caused by melting of toner in the cartridge, which occurs due to the temperature increase around the cartridge or the temperature increase of itself.

In the configuration discussed in Japanese Patent Application Laid-Open No. 2008-268528, the cartridge is cooled by forming an air supplying path in a space between cartridges and sending air through this air supplying path. However, the formation of such an air supplying path between the cartridges necessitates securing of a certain amount of space for the air path between the cartridges, consequently inviting growing in size of the apparatus. Further, there is room for improvement from the viewpoint of cooling efficiency.

Accordingly, from the viewpoint of suppressing the growing in size of the apparatus and/or the cooling efficiency, not the space between the cartridges but a space through which a laser light beam for exposing the photosensitive drum included in the cartridge passes may be used as an air supplying path. However, when the space through which the laser light beam for exposing the photosensitive drum passes is used as the air supplying path, air flows along the surface of the photosensitive drum, creating a possibility of disturbance of a toner image on the photosensitive drum by the air. As a result, a wind velocity or the like is to be limited to prevent disturbance of the toner image, and there is a limit to a cooling capacity.

SUMMARY OF THE INVENTION

The present invention is directed to suppression of growing in size of an apparatus and/or efficient cooling of a cartridge while suppressing disturbance of a toner image on a photosensitive drum.

According to an aspect of the present invention, an image forming apparatus for forming an image on a recording material by exposing a photosensitive member with a light emitting member in a state where a cartridge including the photosensitive member is mounted in an apparatus main body includes a light emitting member including a plurality of light emitting portions arranged in an array, a support member configured to support the light emitting member, and a duct formed in the support member, wherein the duct forms an air supply path extending in a longitudinal direction of the cartridge to cool the cartridge mounted in the apparatus main body.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
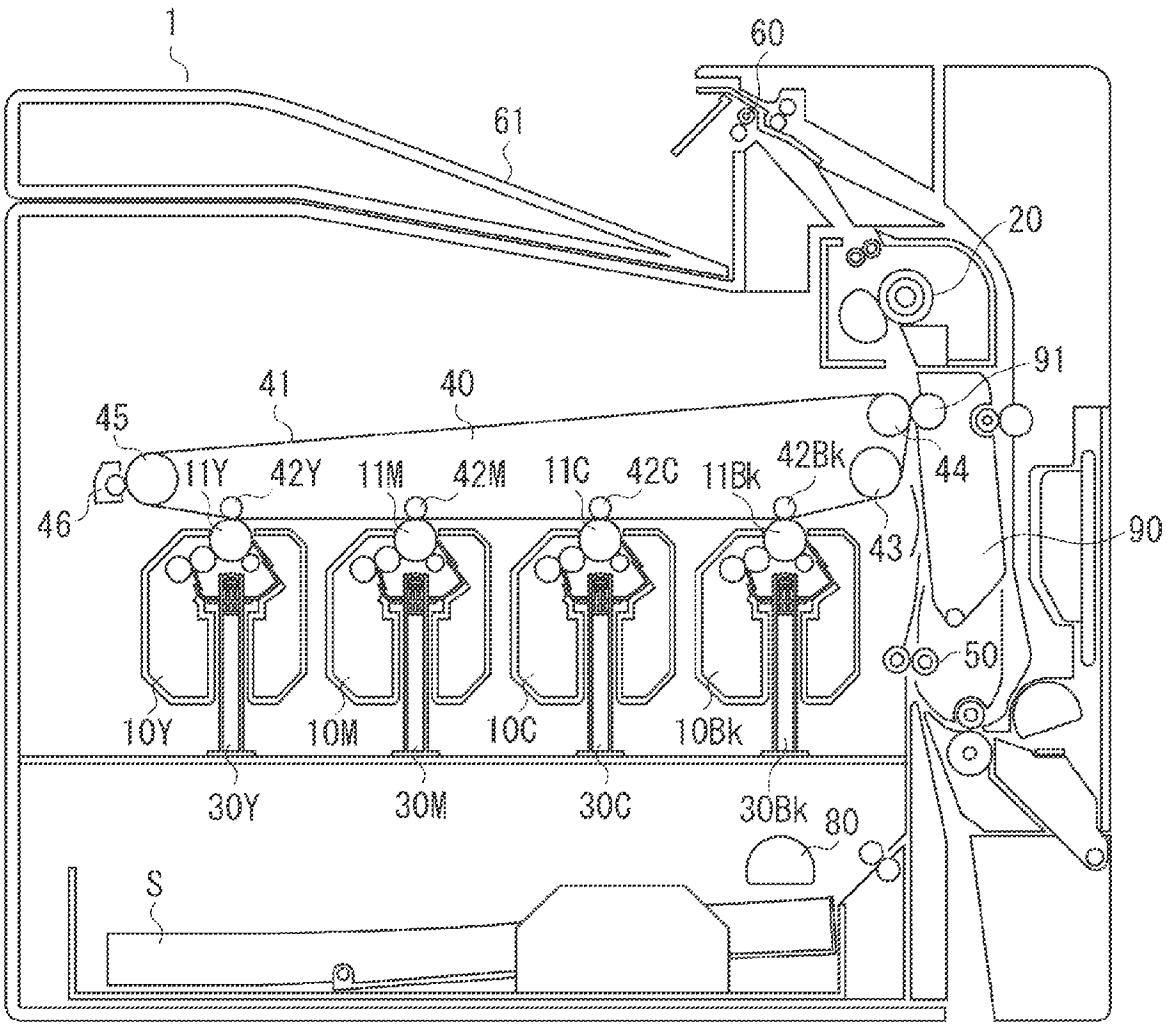
FIG. 1 is a schematic sectional view illustrating an image forming apparatus.

A first exemplary embodiment will be described. First, an overall configuration of an image forming apparatus will be described. FIG. 1 is a schematic sectional view illustrating the overall configuration of the image forming apparatus when seen from a front side of the image forming apparatus. The image forming apparatus 1 is a color LED printer for forming a color image on a sheet (recording material) S by electrophotography. The image forming apparatus 1 includes a sheet feeding unit 80 for storing the sheet S at a lowest stage. A registration roller unit 50 is arranged on the right upper side of the sheet feeding unit 80 to convey the sheet S consistent with the toner image. Above the sheet feeding unit 80, four process cartridges 10 (10Y, 10M, 10C, and 10Bk) respectively including photosensitive drums (photosensitive members) 11 (11Y, 11M, 11C, and 11Bk) are arranged. Above the process cartridge 10, an intermediate transfer unit 40 including an intermediate transfer belt 41 is arranged to face the process cartridge 10. The intermediate transfer unit 40 further includes primary transfer rollers 42 (42Y, 42M, 42C, and 42Bk) for stretching the intermediate transfer belt 41, an intermediate transfer belt driving roller 43, a secondary transfer counter roller 44, and a tension roller 45, which are arranged inside the intermediate transfer belt 41. The intermediate transfer unit 40 further includes a belt cleaning unit 46 for cleaning the intermediate transfer belt 41.

On the right side of the intermediate transfer unit 40, a secondary transfer unit 90 is arranged so that a secondary transfer roller 91 can face the secondary transfer counter roller 44. A fixing unit 20 is arranged above the intermediate transfer unit 40 and the secondary transfer unit 90. On the left upper side of the fixing unit 20, a sheet discharge roller pair 60 is disposed to discharge the recording material to a sheet discharge tray 61.

Next, a configuration of the process cartridge 10 will be described. The four process cartridges 10 (10Y, 10M, 10C, and 10Bk) are similar in structure but different in that they house toner of different colors to form toner images of different colors. Specifically, the process cartridges 10Y, 10M, 10C, and 10Bk respectively house toner of yellow (Y), magenta (M), cyan (C), and black (Bk). Hereinafter, therefore, description of Y, M, C, and K will be omitted, and the process cartridge 10 will be described as a representative of the four process cartridges. The same applies to the components in the process cartridge 10.

Figure 2:
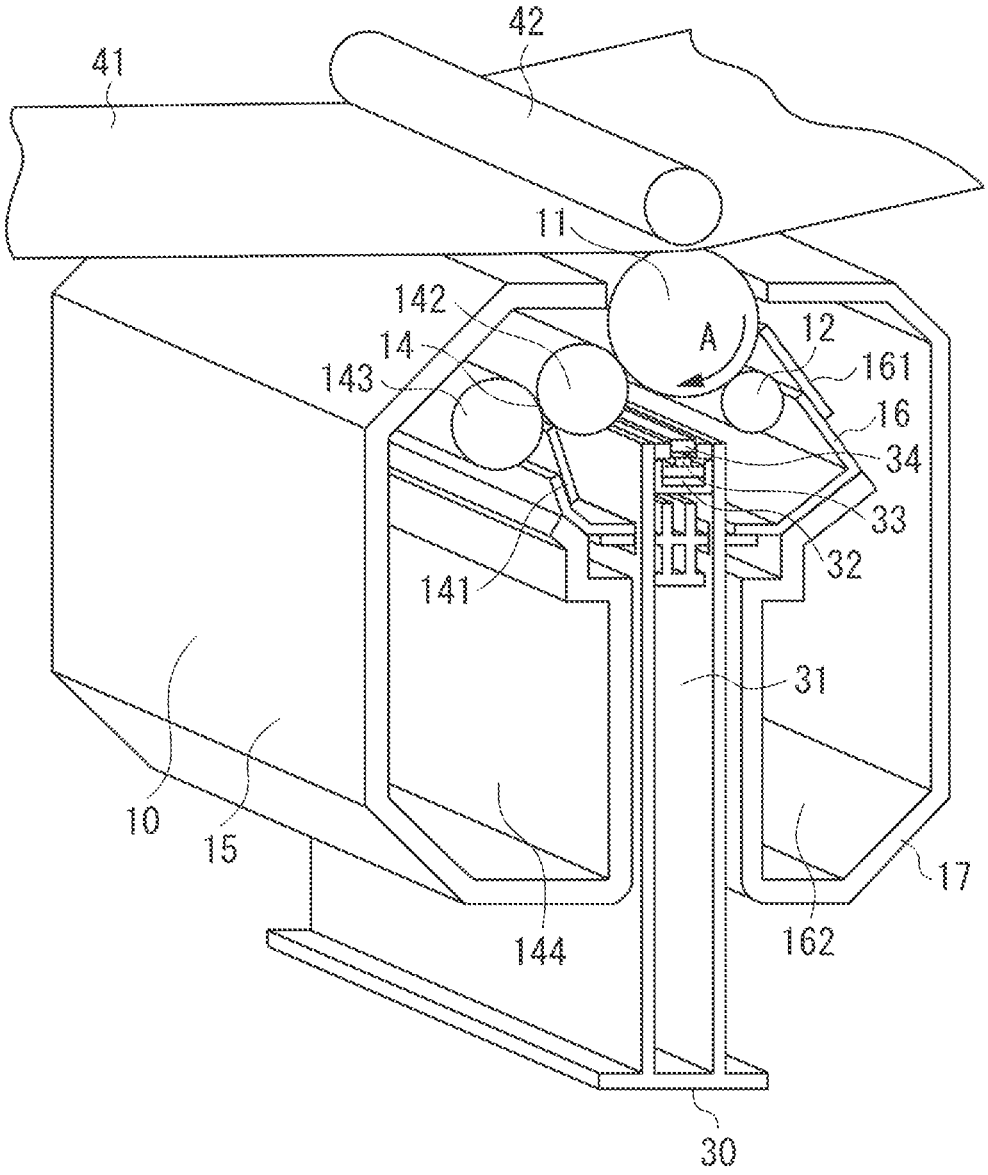
FIG. 2 is a perspective view illustrating a process cartridge.

FIG. 2 is a perspective view illustrating the process cartridge 10 mounted in the image forming apparatus 1. For the purpose of description, a state of a section cut along a direction orthogonal to a rotational axis direction of the photosensitive drum 11 is illustrated. The photosensitive drum 11 is driven to rotate in an arrow A direction illustrated in FIG. 2.

The process cartridge 10 is a unit that includes the photosensitive drum 11 arranged between a first housing 15 and a second housing 17 constituting a frame body, the first housing 15 and the second housing 17, a development unit 14 in the first case 15, a charging roller 12 in the second housing 17, and a cleaning unit 16.

The photosensitive drum 11 has both ends supported by the first housing 15 and the second housing 17 of the process cartridge 10 to be rotatable, and is driven to rotate by a motor (not illustrated) of the apparatus main body, and an image forming operation described below is carried out.

The process cartridge 10 is detachably attached to the image forming apparatus (apparatus main body) 1. In the state where the process cartridge 10 is mounted in the image forming apparatus 1, around the photosensitive drum 11, the charging roller 12, the LED unit 30, the development unit 14, the primary transfer roller 42, and the cleaning unit 16 are arranged in this order from the upstream side to the downstream side in its rotational direction.

The development unit 14 includes a developing blade 141, a developing roller 142, a toner supply/recovery roller 143, and a toner storage unit 144. The developing roller 142 applies, while being driven to rotate by a driving source (not illustrated) disposed in the apparatus main body 1, a developing bias voltage to the developing roller 142 to cause toner to adhere to the photosensitive drum 11. The toner supply/recovery roller 143 supplies toner scooped up by a toner scooping-up device (not illustrated) from the toner storage unit 144 to the developing roller 142, and recovers toner not developed on the photosensitive drum 11. The developing blade 141 regulates a thickness of a toner layer on the developing roller 142. The developing blade 141, the developing roller 142, and the toner supply/recovery roller 143 are developing members for visualize a latent image formed on the photosensitive drum 11 as a toner image (developed image).

The cleaning unit 16 scrapes the toner from the surface of the photosensitive drum 11 by a cleaning blade 161 to recover it in a waste toner container 162. The cleaning blade 161 is a cleaning member for removing toner left on the photosensitive drum 11.

Next, an image forming operation for forming an image on the sheet S will be described. First, a toner image is formed on the photosensitive drum 11 in a rotated state of the photosensitive drum 11. This is carried out as follows. First, the surface of the photosensitive drum 11 is charged by the charging roller 12 to which a charging bias voltage has been applied. Then, light based on image information is radiated to the photosensitive drum 11 by the LED unit 30 described below in detail to form an electrostatic latent image on the photosensitive drum 11. Then, toner (developer) is caused to adhere to the electrostatic latent image by the development unit 14, and the electrostatic latent image is visualized as a toner image (developed image). Accordingly, the toner image is formed on the photosensitive drum 11.

Subsequently, by applying a primary transfer bias voltage to the primary transfer roller 42 from a bias application unit (not illustrated), the toner image on the photosensitive drum 11 is transferred to the intermediate transfer belt 41 (primary transfer). Transfer residual toner left on the surface of the photosensitive drum 11 after the primary transfer is scraped by the cleaning blade 161 of the cleaning unit 16 to be recovered in the waste toner container 162.

The toner image born on the intermediate transfer belt 41 is moved by rotation of the intermediate transfer belt 41. During this movement, toner images similarly formed on the other photosensitive drums 11 are sequentially superimposed to be transferred onto the toner image born on the intermediate transfer belt 41. Accordingly, a toner image of a plurality of colors is formed on the intermediate transfer belt 41. The toner image of the plurality of colors is conveyed to a position facing the secondary transfer roller 91. In synchronization with this conveyance, the sheet S is conveyed, by the registration roller unit 50, to a secondary transfer nip formed between the secondary transfer roller 91 and the secondary transfer counter roller 44 in accordance with the toner image on the intermediate transfer belt 41. Then, by applying a secondary transfer bias voltage to the secondary transfer roller 91 from a bias application unit (not illustrated), the toner image on the intermediate transfer belt 41 is transferred onto the sheet S (secondary transfer).

Then, the sheet S is conveyed to the fixing unit 20. The fixing unit 20 applies heat and pressure to fix the toner image on the sheet S. The sheet S on which the toner image has been fixed is discharged to the sheet discharge tray 61 by the sheet discharge roller pair 60.

Next, referring to FIG. 2, a configuration of the LED unit 30 will be described. With the process cartridge 10 being mounted in the apparatus main body, the LED unit 30 is arranged in a position sandwiched between the first housing 15 and the second housing 17 of the process cartridge 10.

The LED unit 30 includes a LED frame (support member) 31 and a LED head (light emitting member) 32 held by the LED frame 32. The LED head 32 is configured by forming a LED array 33 in which a plurality of light emitting elements (light emitting portions) arrayed at predetermined pitches in a main scanning direction (axial direction of the photosensitive drum 11) are integrated and a lens array 34 into a unit. The LED unit 30 is arranged in close proximity to the bottom surface of each corresponding photosensitive drum 11, and radiates light to the surface of the rotating photosensitive drum 11 to execute exposure.

Next, a method for positioning the process cartridge 10 with respect to the apparatus main body (image forming apparatus 1) and a method for positioning the LED head 32 with respect to the process cartridge 10 will be described.

Figure 3A:
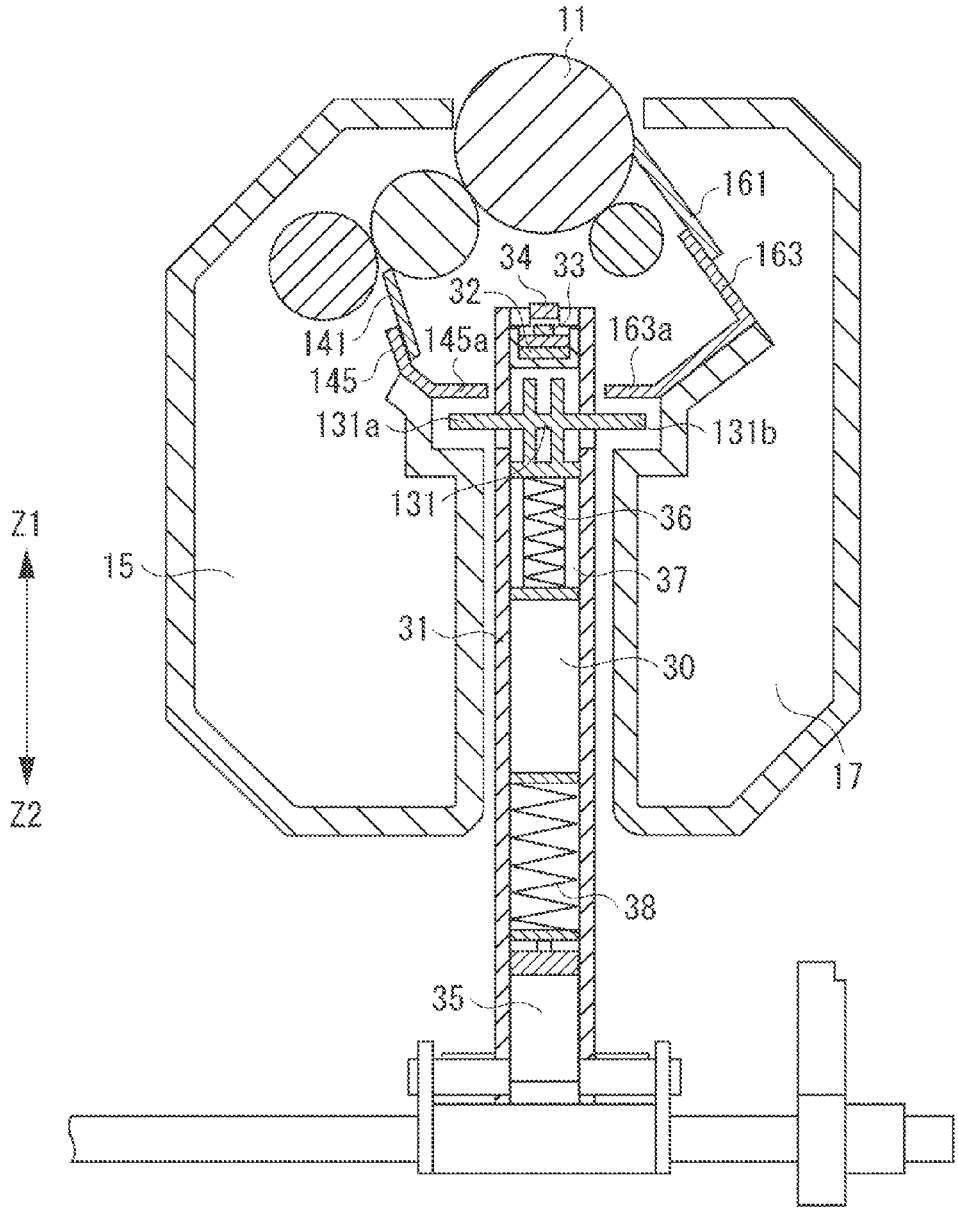
FIG. 3A is a sectional view illustrating the process cartridge (when a light-emitting diode (LED) head and the process cartridge are not positioned).
Figure 3B:
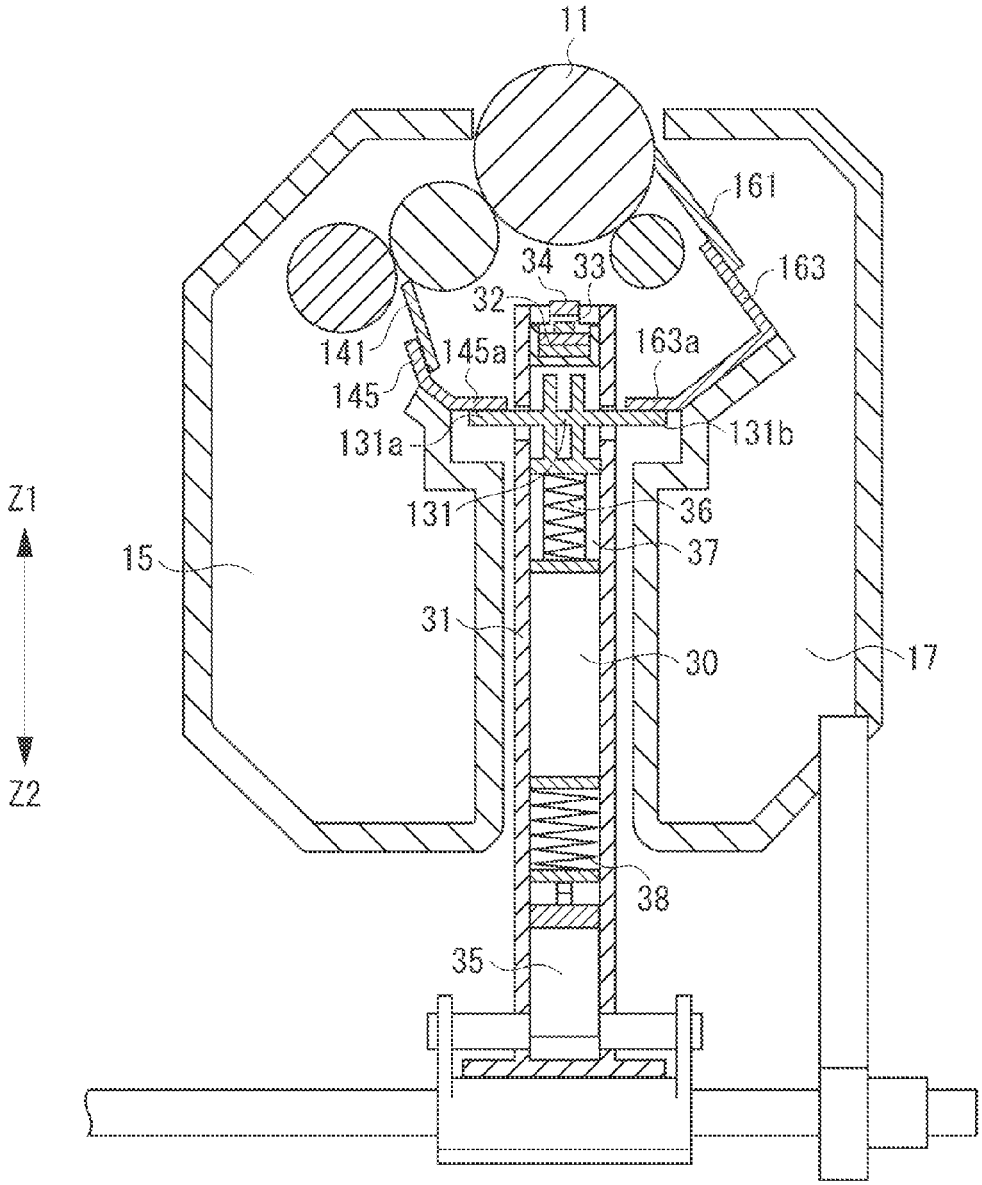
FIG. 3B is a perspective view illustrating the process cartridge (when the LED head and the process cartridge are positioned).
Figure 4A:
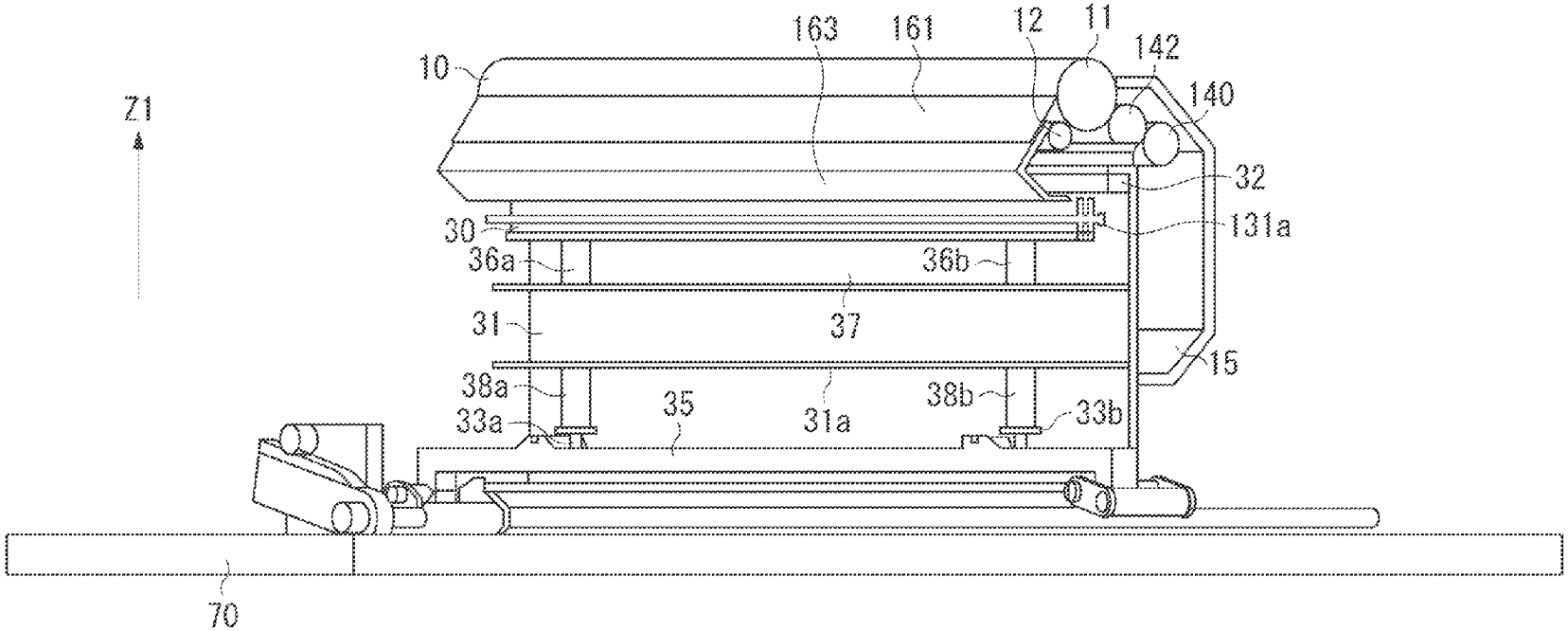
FIG. 4A is a sectional view illustrating a LED unit pressing mechanism (when the LED head and the process cartridge are positioned).
Figure 4B:
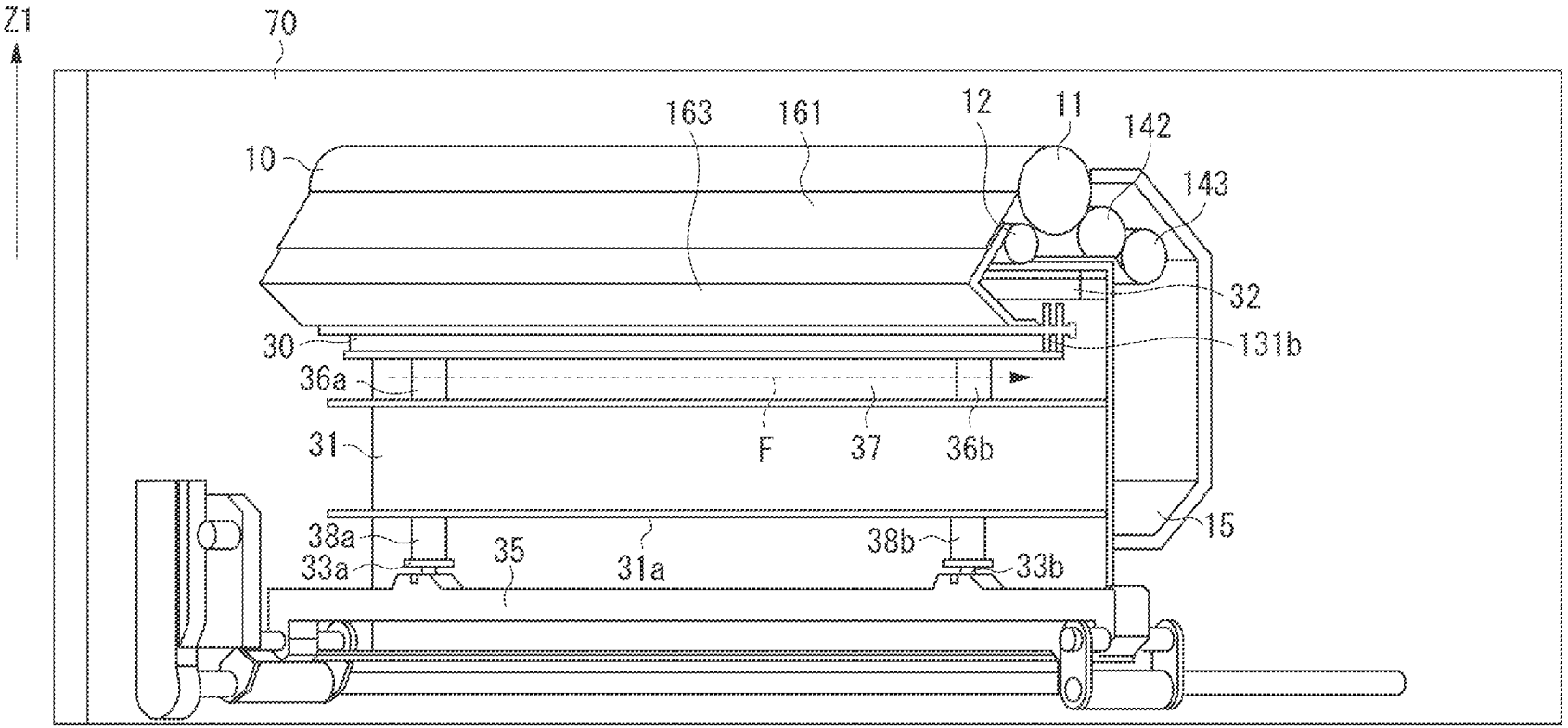
FIG. 4B is a perspective view illustrating the process cartridge (when the LED head and the process cartridge are not positioned).

FIGS. 3A and 3B are schematic sectional views illustrating the members around the process cartridge 10 of the image forming apparatus 1 when seen from the front side of the apparatus: FIG. 3A illustrating a state before the LED unit 30 and the process cartridge 10 are positioned, and FIG. 3B illustrating a positioned state. FIGS. 4A and 4B are perspective views of the process cartridge 10 mounted in the apparatus main body when seen from the back side of the apparatus main body: FIG. 4A illustrating a state before the process cartridge 10 is positioned, and FIG. 4B illustrating a positioned state. For simplicity, only the members around the process cartridge 10 of the image forming apparatus 1 are illustrated, and the section of the process cartridge 10 cut perpendicularly to the axis of the photosensitive drum 11 is illustrated.

The image forming apparatus 1 includes a door 70 in the front. By opening the door 70, the process cartridge 10 is moved in the axial direction of the photosensitive drum 11 with respect to the image forming apparatus 1 to be detachably attached to the front side of the apparatus main body.

As illustrated in FIGS. 3A and 4A, by closing the door 70 with the process cartridge 10 being inserted into a space in the apparatus main body, the process cartridge 10 is moved up (Z1 direction) by a moving unit (not illustrated). An abutting portion (not illustrated) of the process cartridge 10 abuts on an abutting surface of the image forming apparatus 1. Accordingly, as illustrated in FIGS. 3B and 4B, the process cartridge 10 is positioned with respect to the image forming apparatus 1 to be fixed.

Next, the method for positioning the LED head 32 and the process cartridge 10 will be described. As illustrated in FIGS. 3A and 4A, in the inserted state of the process cartridge 10 into the space in the apparatus main body, the LED head 32 is in a position retracted from the photosensitive drum 11. By closing the door 70 in this state, a lever 35 moves up (Z1 direction) in the axial direction of the photosensitive drum 11 in association with the door 70. Accordingly, spring seats 33 (33*a* and 33*b*) of springs 38 (38*a* and 38*b*) for pressing the LED unit 30 upward (Z1 direction) are lifted up (Z1 direction). By this operation, the springs 38 (38*a* and 38*b*) push up a pressed surface 31*a* of the LED frame 31. Then, an abutting portion (not illustrated) formed in the LED head 32 abuts on abutting surfaces formed at both ends of the process cartridge 10 positioned to be fixed to the image forming apparatus 1 in the axial direction of the photosensitive drum 11. Thus, a state where the LED head 32 has been positioned with respect to the process cartridge 10 illustrated in FIGS. 3B and 4B is set, and the LED head 32 is set at a position for exposing the photosensitive drum 11.

During image formation, a temperature of air around the process cartridge 10 increases because of heat generated by the driving source such as a motor or the fixing unit 20 in the apparatus main body, thereby warming the process cartridge 10. Further, during the image formation, a temperature of the process cartridge 10 performs self temperature rise because of friction between the developing blade 141 and the developing roller 142 or friction between the cleaning blade 161 and the photosensitive drum 11 in the process cartridge 10. When the process cartridge 10 warms up, the following phenomena occur and problems such as a defective image may occur.

The toner in the toner container 144 is melted to firmly fix to the inside of the process cartridge 10. The melted toner is welded to the photosensitive drum. Deterioration of charging performance causes reduction of an image density. A temperature distribution in the developing blade 141 is uniform or not uniform in a longitudinal direction (axial direction of the photosensitive drum 11) to generate image unevenness. The temperature of the cleaning blade rises to make unstable blade abutting pressure, thus causing reduction of cleaning performance.

Such phenomena occur more easily especially as the image forming apparatus is miniaturized or speeded up to facilitate the temperature increase of the process cartridge 10.

The image forming apparatus 1 therefore includes a configuration to cool the process cartridge 10. Referring to FIGS. 3A and 3B, this cooling configuration will be described.

The LED frame 31 holds a metal heatsink member (cooling member) 131 having high heat exchanging performance, and the heatsink member 131 is supported on the LED frame 31 via springs 36 (36*a* and 36*b*) arranged at both ends in the axial direction of the photosensitive drum 11. In the heatsink member 131, abutting portions 131*a* and 131*b* are formed outside the LED frame 31 to come into contact with the developing blade 141 and the cleaning blade 161 that are cooling targets.

A supporting metal plate (first member) 145 in contact with the developing blade 141 and a supporting metal plate (second member) 163 in contact with the cleaning blade 161 extend toward the LED frame 31. Beyond the extending portions, abutting portions 145*a* and 163*a* are formed to come into contact with the abutting portions 131*a* and 131*b* of the heatsink member 131.

As illustrated in FIG. 3A, even when the process cartridge 10 is inserted into the apparatus main body, in the opened state of the door 70, the abutting portions 131*a* and 131*b* are not in contact with the abutting portions 145*a* and 163*a*. By closing the door 70 from this state, the LED frame 31 is pushed up (Z1 direction) as described above. Thus, the heatsink member 131 is also pushed up in the Z1 direction via the springs 36 (36*a* and 36*b*), and the abutting portions 131*a* and 131*b* come into contact with (abut on) the abutting portions 145*a* and 163*a*. In other words, the heatsink member 131 is movable vertically (Z1 and Z2 directions) with respect to the LED frame 31, and the abutting portions 131*a* and 131*b* are pressed toward the abutting portions 145*a* and 163*a* by action of the springs 36 (36*a* and 35*b*) to come into contact with the same. Thus, since the heatsink member 131 is movable with respect to the LED frame 31, the contact between the abutting portions 131*a* and 131*b* and the abutting portions 145*a* and 163*b* prevents erroneous positioning of the LED head 32 with respect to the process cartridge 10.

Figure 5:
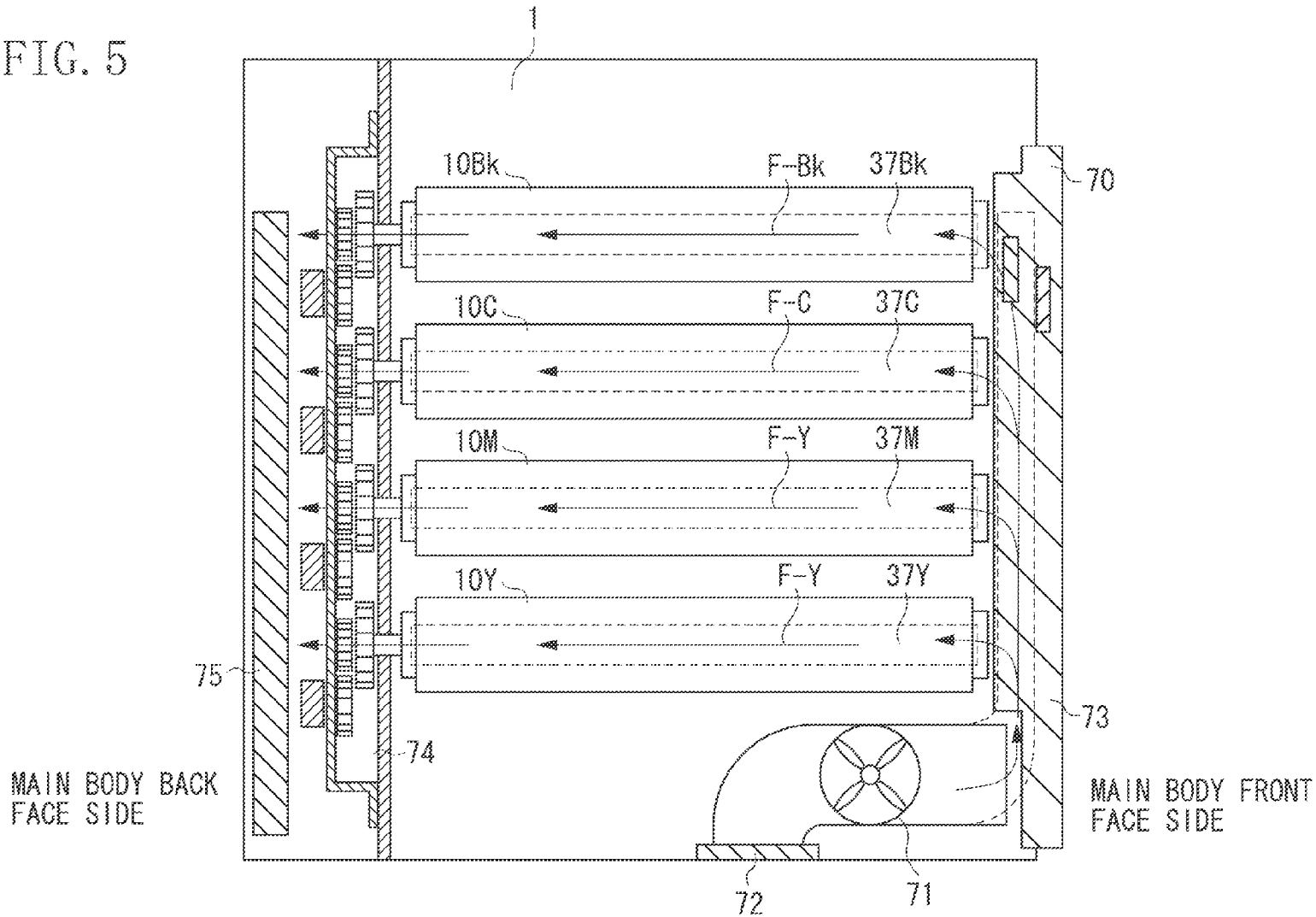
FIG. 5 is a sectional view illustrating an air supplying path configuration.

FIG. 5 is a sectional view illustrating an air supply path for cooling the heatsink member 131 when a top surface of the processing cartridge 10 is seen from a main body top surface direction according to the present exemplary embodiment. The image forming apparatus 1 includes a blower fan 71 disposed as a blowing unit on an apparatus main body wall surface, which blows air sucked from a air intake 72 formed on the left wall surface of the image forming apparatus 1 into the apparatus main body. In the closed state of the door 70, the air blown from the blower fan 71 passes through a blower duct 73 in the door 70 to flow to ducts 37 (37Y, 37M, 37C, and 37Bk) formed in the LED frame 31. The ducts 37 (37Y, 37M, 37C, and 37Bk) form air supply paths F (F-Y, F-M, F-C, and F-Bk) through which the air for cooling the heatsink member 131 passes. The flowing of the air through these air supply paths F (generation of air current) cools the heatsink member 131. The duct 37 is provided extending in the longitudinal direction of each process cartridge 10. In the air supply path F, the air flows in the longitudinal direction of each process cartridge 10.

In the present exemplary embodiment, a power source unit 75 (an electric component such as a motor or a substrate) and a driving unit 74 (a mechanical component such as a gear) are arranged on a side (main body back face side) opposite a side (main body front face side) for detachably attaching the process cartridges 10 (10Y, 10M, 10C, and 10Bk). Accordingly, the process cartridge 10 to be cooled is located closer to the air supply path upstream side than the motor or the substrate as a heat generation source, and heating is difficult before air flows in the process cartridge 10. As a result, heat can be efficiently removed from the process cartridge 10, and the developing blade 141 and the cleaning blade 161 that are the cooling targets can be efficiently cooled. In the present exemplary embodiment, the two sets of abutting portions are in contact with (abut on) each other, namely, the abutting portion 131*a* with the abutting portion 145 and the abutting portion 131*b* with the abutting portion 163*a*. However, it is sufficient that at least one set be in contact with each other.

The present exemplary embodiment has been described by taking the example of the color LED example. However, a similar configuration is applicable to a monochrome LED printer. In the present exemplary embodiment, the heatsink member 131 is pressed toward the process cartridge 10 by the springs 36 (36*a* and 3*b*). However, the abutting portions 145*a* and 163*a* of the process cartridge 10 side can be pressed toward the heatsink member 131.

In the present exemplary embodiment, the process cartridge 10 is cooled from the image forming apparatus front side by the blower fan 71. However, the cooling unit is not limited to the blower unit. A heat exchanging unit such as a heat pipe can be used.

As described above, in the present exemplary embodiment, the duct 37 is formed in the LED frame 31 for supporting the LED head 32. Thus, the air supply path for cooling the process cartridge 10 can be formed by efficiently using the space in the image forming apparatus 1, and growing in size of the apparatus can be suppressed. Because of the duct 37 formed in the LED frame 31, even when air is blown, it is difficult for the toner on the photosensitive drum to be disturbed by the air or adhere to the developing unit 14 or the cleaning unit 16, or for the housed toner to fly. Thus, a wind velocity can be freely set, and certain cooling performance can be secured. As a result, the process cartridge can be efficiently cooled.

Further, in the present exemplary embodiment, in relation to (association with) the movement of the LED head 32 from the position retracted from the photosensitive drum 11 to the position for exposing the photosensitive drum 11, the heatsink member 131 moves to the position where the abutting portion 131*a* comes into contact with the abutting portion 145*a* and the abutting portion 131*b* comes into contact with the abutting portion 163*a*. With the configuration where the heatsink member 131 moves in association with the LED head 32, a mechanism of moving the heatsink member 131 and a mechanism of moving the LED head 32 can be made common. Thus, as compared with a case where the respective moving mechanisms are separately arranged, costs or a space occupied by the moving mechanisms can be reduced.

Next, a second exemplary embodiment will be described. Components similar to those of the first exemplary embodiment will be denoted by similar reference numerals, and description thereof will be omitted.

Figure 6A:
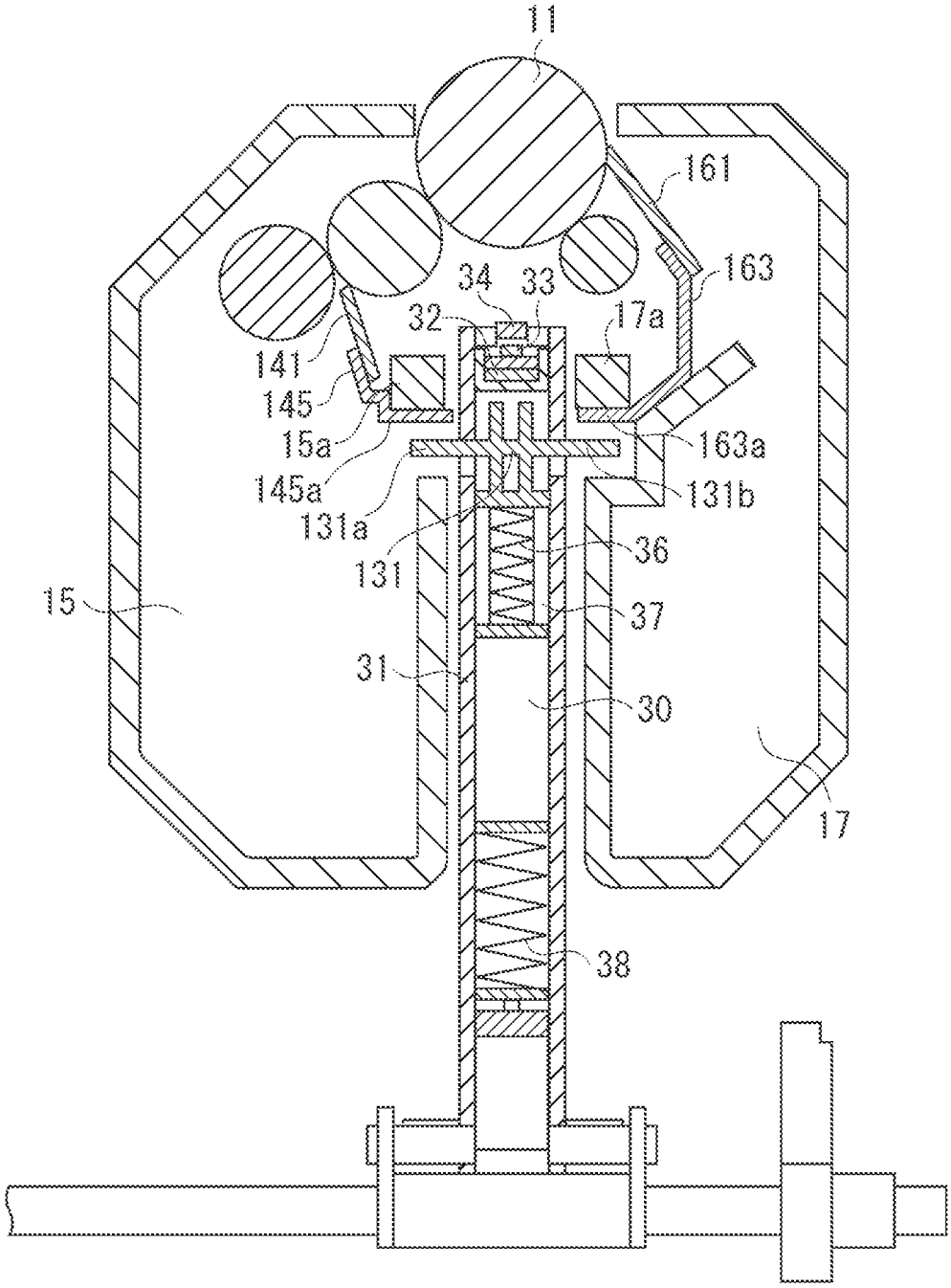
FIG. 6A is a sectional view illustrating the process cartridge (when the LED head and the process cartridge are not positioned).
Figure 6B:
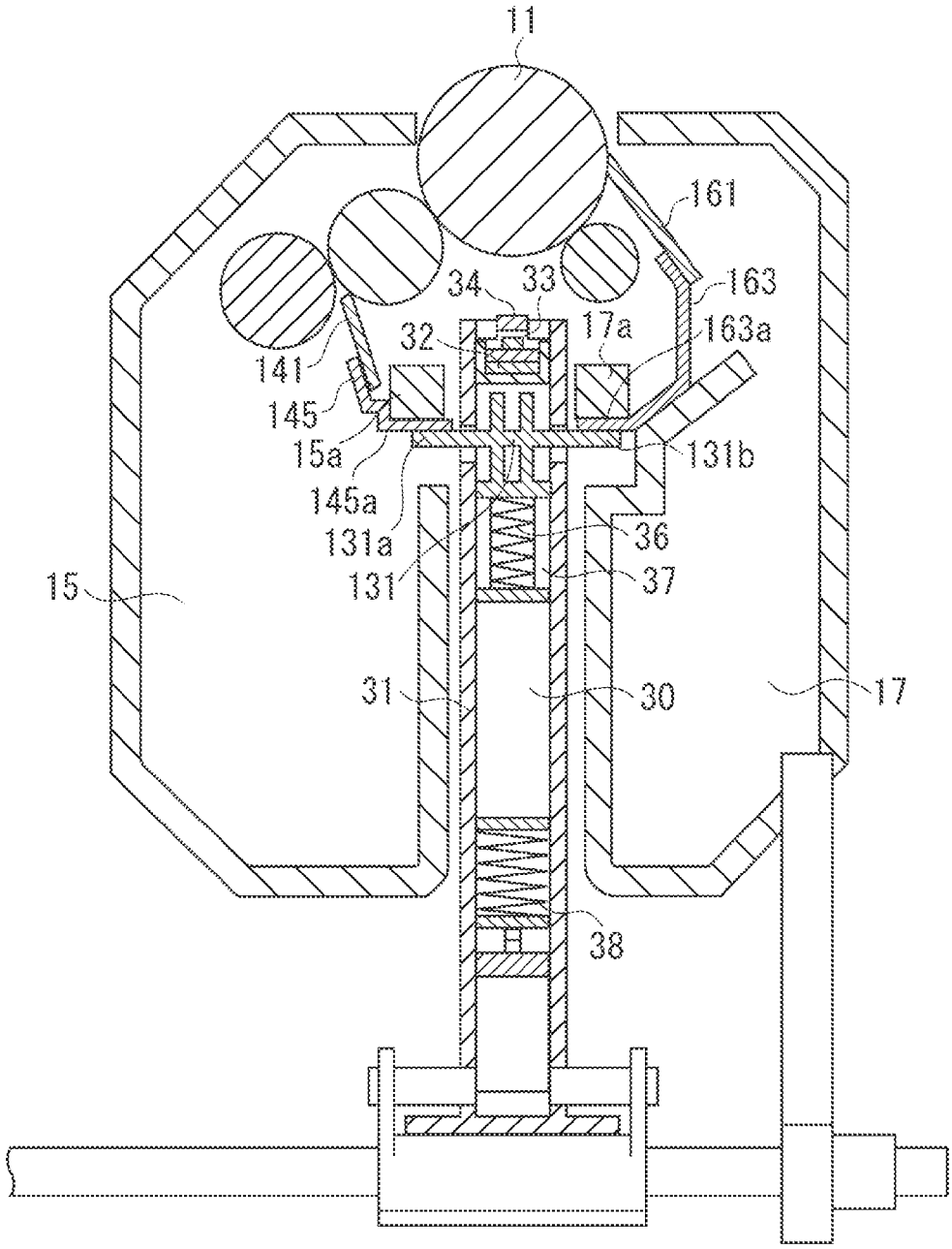
FIG. 6B is a sectional view illustrating the process cartridge (when the LED head and the process cartridge are positioned).

Referring to FIGS. 6A and 6B, a configuration of a cooling unit will be described. FIG. 6A illustrates a state before a LED unit 30 and a process cartridge 10 are positioned, and FIG. 6B illustrates a positioned state. As in the case of the first exemplary embodiment, the LED unit 30 includes a heatsink member 131. In the heatsink member 131, abutting portions 131*a* and 131*b* are formed outside a LED frame 31 to come into contact with cooling target members of the process cartridge 10, and abutting portions 145*a* and 163*a* are formed in supporting metal plates 145 and 163 of each blade.

In the present exemplary embodiment, the supporting metal plate 145 is supported by a columnar portion 15*a* formed integrally with a first housing 15 of the process cartridge 10, and the supporting metal plate 163 is supported by a columnar portion 17*a* formed integrally with a second housing 17. In this case, the columnar portions 15*a* and 17*a* are arranged in positions facing the abutting portions 131*a* and 131*b* of the heatsink member 131 across the abutting portions 145*a* and 163*a*. Accordingly, when the abutting portions 131*a* and 131*b* respectively come into contact with the abutting portions 145*a* and 163*a*, the columnar portions 15*a* and 17*a* can receive forces applied on the supporting metal plates 145 and 163, orientation changes of a developing blade 141 and a cleaning blade 161 are minimized, and misalignment of each of the blades caused by the contact is prevented. Thus, the present exemplary embodiment can provide the same effects as those of the first exemplary embodiment. Further, orientation changes of the developing blade 141 and the cleaning blade 161 caused by the contact of the heatsink member 131 can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-267152 filed Dec. 6, 2011, which is hereby incorporated by reference herein in its entirety.

What is claimed is:

1. An image forming apparatus for forming an image on a recording material by exposing a photosensitive member with a light emitting member in a state where a cartridge including the photosensitive member is mounted in an apparatus main body, the image forming apparatus comprising:

a light emitting member including a plurality of light emitting portions arranged in an array;

a support member configured to support the light emitting member; and a duct formed in the support member, wherein the duct forms an air supply path extending in a longitudinal direction of the cartridge to cool the cartridge mounted in the apparatus main body.

2. The image forming apparatus according to claim 1, wherein the cartridge includes a first housing and a second housing arranged to sandwich the photosensitive body, and the duct is set at a position sandwiched between the first housing and the second housing in a state where the cartridge is mounted in the apparatus main body.

3. The image forming apparatus according to claim 2, wherein the support member includes a cooling member abutting on at least one of the first housing and the second housing of the cartridge to cool the cartridge, and the cooling member is cooled by an air current of the air supply path formed in the duct.

4. The image forming apparatus according to claim 3, wherein the first housing includes a first member in contact with a developing member for making a latent image formed on the photosensitive member visible as a developed image, the second housing includes a second member in contact with a cleaning member for removing a developer left on the photosensitive member, and the cooing member abuts on at least one of the first member and the second member.

5. The image forming apparatus according to claim 3, wherein the light emitting member is movable between a position for exposing the photosensitive body and a position retracted from the photosensitive body and, in association with movement of the light emitting member from the retracted position to the exposure position, the cooling member moves from a position away from the cartridge to a position for abutting on the cartridge.

6. An image forming apparatus for forming an image on a recording material by exposing a photosensitive member with a light emitting member present at an exposure position in a state where a cartridge including the photosensitive member is mounted in an apparatus main body, the image forming apparatus comprising:

a light emitting member including a plurality of light emitting portions arranged in an array, wherein the light emitting member is movable between a position for exposing the photosensitive body and a position retracted from the photosensitive member; and a cooling member abutting on the cartridge to cool the cartridge, wherein in association with movement of the light emitting member from the retracted position to the exposure position, the cooling member moves from a position away from the cartridge to a position for abutting on the cartridge.

7. The image forming apparatus according to claim 6, further comprising a support member configured to support the light emitting member and the cooling member, wherein, according to movement of the support member, the light emitting member moves between the retracted position and the exposure position, and the cooling member moves from a position away from the cartridge to a position for abutting on the cartridge.

* * * * *